US006716539B2

(12) United States Patent
Subramanian

(10) Patent No.: US 6,716,539 B2
(45) Date of Patent: Apr. 6, 2004

(54) DUAL MICROSTRUCTURE THERMAL BARRIER COATING

(75) Inventor: Ramesh Subramanian, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 155 days.

(21) Appl. No.: 09/962,734

(22) Filed: Sep. 24, 2001

(65) Prior Publication Data

US 2003/0228441 A1 Dec. 11, 2003

(51) Int. Cl.[7] ..... B21D 39/00

(52) U.S. Cl. ..... 428/621; 428/622; 428/623; 428/632; 428/141; 428/148; 427/255.28; 427/255.7; 427/269; 427/249.9; 416/241 B

(58) Field of Search ..... 428/621, 622, 428/623, 141, 148, 632; 427/269, 249.9, 255.28, 255.7; 416/241 B

(56) References Cited

U.S. PATENT DOCUMENTS

| | | | |
|---|---|---|---|
| 4,377,371 | A | 3/1983 | Wisander et al. |
| 4,405,659 | A | 9/1983 | Strangman |
| 4,457,948 | A | 7/1984 | Ruckle et al. |
| 5,073,433 | A | 12/1991 | Taylor |
| 5,352,540 | A | 10/1994 | Schienle et al. |
| 5,558,922 | A | 9/1996 | Gupta et al. |
| 5,562,998 | A | 10/1996 | Strangman |
| 5,576,069 | A | 11/1996 | Chen et al. |
| 5,683,825 | A | 11/1997 | Bruce et al. |
| 5,705,231 | A | 1/1998 | Nissley et al. |
| 5,830,586 | A | 11/1998 | Gray et al. |
| 6,057,047 | A | 5/2000 | Maloney |
| 6,110,604 | A | 8/2000 | Rickerby |
| 6,224,963 | B1 | 5/2001 | Strangman |

FOREIGN PATENT DOCUMENTS

EP 0 916 744 A2 11/1998

OTHER PUBLICATIONS

Haddadi, A., et al. Cystalline Growth within Alumina and Zirconia Coatings with Coating Temperataure Control During Spraying. Thermal Spray: Practical Solutions for Engineering Problems. C.C. Berndt, (Ed.). Materials Park, Ohio: ASM International, 1996, pp. 615–622.

Johner, G. et al. Experimental and Theoretical Aspects of Thick Thermal Barrier Coatings for Turbine Applications. Proceedings of the National Thermal Spray Conference, Orlando, FL, 1987. D.L. Houck, (Ed.), 1987. pp. 155–166.

Nerz, John E., et al. Taguchi Analysis of Thick Thermal Barrier Coatings. Thermal Spray Research and Applications, Proceedings of the Third National Thermal Spray Conference, Long Beach, CA, May 20–25, 1990, pp. 669–673.

*Primary Examiner*—William P. Watkins, III
*Assistant Examiner*—Jane Rhee

(57) ABSTRACT

A multi-layer thermal barrier coating (12) having a porous first layer of ceramic insulating material (20) and a second relatively dense layer of ceramic insulating material (22) having a plurality generally vertical gaps (26) formed therein. The porous conventional as-deposited APS microstructure of the first layer provides thermal and chemical protection for the substrate, while the gaps of the columnar-grained second layer provide thermal shock resistance for the coating. An air plasma spray process may be used to deposit both the first and the second layers of material, as well as any underlying bond coat layer. The gaps of the columnar-grained second layer do not extend into the first layer. The pores (28) of the first layer function as crack-arrestors for cracks initiating at the gaps of the second layer.

20 Claims, 1 Drawing Sheet

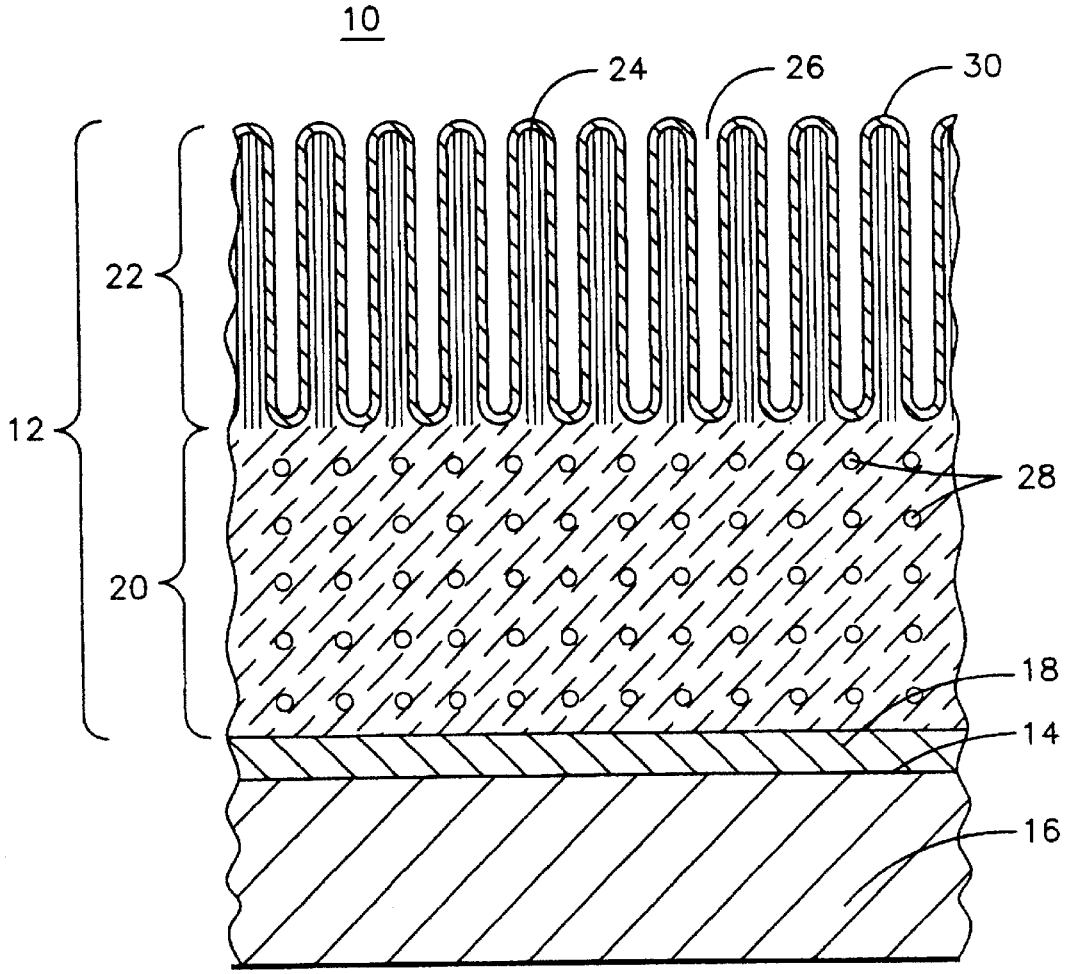
10
24
26
30
22
12
28
20
18
14
16

DUAL MICROSTRUCTURE THERMAL BARRIER COATING

FIELD OF THE INVENTION

This invention relates generally to the field of thermal barrier coatings used to insulate substrate materials from high temperature environments, such as ceramic coatings applied to metal substrates. This invention has specific application for a ceramic thermal barrier coating applied to a superalloy component of a gas turbine engine.

BACKGROUND OF THE INVENTION

It is well known to apply a thermal barrier coating (TBC) to a substrate material to inhibit the flow of heat into the substrate. Such coatings commonly protect alloy components of gas turbine engines that are exposed to the hot combustion gas.

Ceramic thermal barrier coating materials may be applied to a metal alloy substrate by a vapor deposition process, such as electron beam physical vapor deposition (EB-PVD). A ceramic layer deposited by vapor deposition may form a columnar-grained structure, wherein a plurality of individual columns of directionally solidified ceramic material are separated by small gaps extending through essentially the entire thickness of the TBC layer. Individual columns may be about 10–30 microns wide and the gaps between columns may be about 1–2 microns wide. One such approach is described in U.S. Pat. No. 4,405,659 to Strangman. The gaps between the various columns of material function to relieve stress in the material, thereby reducing its susceptibility to failure caused by thermal shock. Unfortunately, EB-PVD is known to be an expensive process. Furthermore, the gaps between the columns provide pathways for penetration of contaminants from a high temperature environment, thereby reducing the effectiveness of the insulating layer and facilitating the oxidation or corrosion of the underlying bond coat and/or substrate material.

It is known to apply a ceramic thermal barrier coating material by an air plasma spray (APS) process. Such coatings are formed by heating a gas-propelled spray of a powdered metal oxide or non-oxide material with a plasma spray torch. The spray is heated to a temperature at which the powder particles become molten. The spray of molten particles is directed against a substrate surface where they solidify upon impact to create the coating. The conventional as-deposited APS microstructure is known to be characterized by a plurality of overlapping splats of material, wherein the inter-splat boundaries may be tightly joined or may be separated by gaps resulting in some porosity. The individual splats of the conventional as-deposited APS microstructure are characterized by intra-splat columns of directionally solidified material extending through the thickness of the splat, typically 2–5 microns. This structure is referred to hereinafter as "conventional as-deposited APS microstructure." Such coatings are generally less expensive to apply than EB-PVD coatings and they provide a better thermal and chemical seal against the surrounding environment than do columnar-grained structures. However, unlike the columnar-grained structure, the inter-splat gaps in the conventional as-deposited APS microstructure tend to densify upon exposure to high temperatures and fast temperature transients. Such densification may result in a shorter operating life in a gas turbine environment.

It is possible to achieve a columnar grained structure by using an APS process to deposit a ceramic thermal barrier coating, as described in U.S. Pat. No. 5,830,586 to Gray, et al., incorporated by reference herein. These gaps may be 200–300 microns apart with fully dense columnar material there between. Although the spacing of these gaps is somewhat different than the gaps in the columnar grained structure obtained by EB-PVD, such gaps still provide strain tolerance for the materials. Accordingly, the term "columnar grained material" as used herein is meant to encompass all such structures regardless of the method of deposition. Gray teaches that when the temperature of the particle-receiving surface is controlled to a desired high temperature, the overlapping layers of deposited material will flow together in a micro-welding process to form a columnar ordering of the adjacent particle layers. While such a structure may have some advantages when compared to the conventional as-deposited APS microstructure, the high temperature necessary for deposition can cause oxidation of the underlying bond coat during the deposition process, thereby resulting in poor bonding between the thermal barrier coating layer and the bond coat and early failure of the TBC.

It is also known to use a quenching process to create a fine network of cracks in a plasma flame sprayed ceramic thermal barrier coating, as described in U.S. Pat. No. 4,457,948 to Ruckle. The network of cracks serve to relieve strain in the material, thereby improving its performance under thermal transient conditions. While the plasma spray processes described by Gray and Ruckle may be less expensive than an EB-PVD process, the resulting coatings still suffer from the disadvantages described above due to the encroachment of the high temperature environment through the strain-relieving gaps or cracks.

U.S. Pat. No. 5,576,069 to Chen, et al., describes a laser re-melting process for improved sealing of a plasma-sprayed thermal barrier coating. A high power laser beam is used to melt a thin layer on a surface of a plasma-sprayed coating. The glazed surface provides an improved seal against an oxidizing environment. However, such a coating lacks the thermal stress compliance of a columnar-grained coating.

SUMMARY OF THE INVENTION

The present invention includes a strain-tolerant thermal barrier coating and method of making such a coating for protecting an article from exposure to a high temperature oxidizing environment.

A thermal barrier coating is described herein as including: a first layer of ceramic insulating material having a conventional as-deposited APS microstructure; and a second layer of ceramic insulating material disposed on the first layer, the second layer having a columnar-grained structure. The first layer may have a density of no more than 70–85% of its theoretical density. The second layer may have a density of at least 85% of its theoretical density. A sinter-inhibiting material may be disposed on the second layer between adjacent columns of the columnar-grained structure.

An article having a thermal barrier coating is described herein as including: a substrate having a surface; a thermal barrier coating deposited over the surface of the substrate, the thermal barrier coating further comprising: a first layer of ceramic insulating material having a conventional as-deposited APS microstructure disposed over the substrate surface; and a second layer of ceramic insulating material disposed on the first layer, the second layer having a columnar grained structure. A bond coat material may be deposited between the substrate surface and the first layer of ceramic insulating material.

A method of insulating a substrate is described herein as including: depositing a first layer of a ceramic insulating material over the substrate using an air plasma spray process to obtain a conventional as-deposited APS microstructure in the first layer; and depositing a second layer of a ceramic insulating material over the first layer using a process that results in a columnar-grained structure in the second layer. The first layer may be deposited to have a density of no more than 70–85% of its theoretical density. The second layer may be deposited to have a density of at least 85% of its theoretical density. The method may further include depositing a sinter-inhibiting material on the second layer between adjacent columns of the columnar-grained structure. The first layer may be deposited to have pores so that the pores in the first layer arrest the propagation of cracks originating in the second layer.

BRIEF DESCRIPTION OF THE DRAWINGS

The sole FIGURE is a partial cross-sectional view of a component formed of a metal-alloy substrate protected by a multi-layered ceramic thermal barrier coating.

DETAILED DESCRIPTION OF THE INVENTION

The applicant has discovered a strain-tolerant thermal barrier coating and method of applying such a coating. The multi-layer thermal barrier coating described herein provides a high degree of thermal insulation and chemical isolation for an underlying substrate material against a high temperature, oxidizing environment, and it provides a strain-tolerant structure for withstanding the stresses imposed during thermal transient conditions. The Figure is a partial cross-sectional view of a component 10 manufactured with such a coating. The component may be, for example, a portion of a gas turbine engine that is exposed to the flow of hot combustion gasses.

Component 10 includes a thermal barrier coating 12 applied over a surface 14 of a substrate material 16. The substrate material 16 may be, for example, a nickel or cobalt based superalloy material or other material used to fabricate an article that will be subjected to a high temperature environment. Substrate 16 may have the thermal barrier coating 12 applied over all or part of surface 14. In some applications, a layer of a bond coat material 18 may be applied between the substrate 16 and the thermal barrier coating 12 in order to promote improved bonding there between. Common bond coat materials include the family of alloys known as MCrAlY, where M is nickel, cobalt or a combination of nickel and cobalt. Other bond coat materials include MCrAlY with a platinum enriched surface and a diffused platinum aluminide coating. The bond coat 18 may be applied to the substrate 16 by any process known in the art, for example plasma spraying or electro-deposition.

The thermal barrier coating 12 includes a first layer of insulating material 20 disposed over the substrate surface 14. In the embodiment of the Figure, the first layer 20 is deposited on the bond coat material 18, although in some embodiments, the first layer may be applied directly onto the substrate surface 14. The thermal barrier coating 12 further includes a second layer of insulating material 22 disposed over the first layer 20, with the properties of the two layers being advantageously different as described herein. The thermal barrier coating 12 may comprise a ceramic insulating material applied by a plasma spray process such as APS. Although each of the first layer of insulating material 20 and the second layer of insulating material 22 have different structures, they may have the same chemical composition, or alternately, they may be have different chemical compositions. One widely used ceramic insulating material is 6–8 weight percent yttria stabilized zirconia, although other oxide or non-oxide ceramic insulating materials as are known in the art may be used.

The first layer 20 and second layer 22 advantageously have different grain structures resulting from a change in the deposition process between the first layer 20 and the second layer 22. First layer of insulating material 20 may have a conventional as-deposited APS microstructure. The first layer 20 may include a plurality of open pores 28 which reduce its actual density to somewhat below its theoretical density. The first layer of insulating material 20 may have a density of no more than 85% of its theoretical density, or in the range of 70–85% of its theoretical density. Such a generally porous material will have lower thermal conductivity than would a similar layer having a higher density, and also will have lower thermal conductivity than would a columnar-grained layer of the same material. The generally equiaxed-grained structure presents a barrier against contact between the outside oxidizing environment and the underlying bond coat 18 or substrate material 16.

The second layer of insulating material 22 has a generally columnar-grained structure wherein columns of material 24 are separated by a respective plurality of gaps 26. The gaps 26 extend in a direction transverse to a plane of interface between the first 20 and second 22 layers but do not extend into the first layer 20. The material 24 between the gaps 26 is made of one or more grains, with each grain having a high aspect ratio of height/width in the range of 50–400, or preferably around 200. The number of grains between adjacent gaps 26 may be in the range of 5–300 depending upon the deposition process, with each grain having a width of from about 1–3 microns. The width of each gap 26 may be in the range of 1–2 microns. Such columnar grained structures may be deposited using an APS deposition process through techniques known in the art. The deposition process may be controlled so that the gaps 26 extend in a direction having an angle of at least 75 degrees from a plane of interface between the first and second layers. Any other known process may be used to obtain a second layer of material 22 having a plurality of generally vertical gaps. If a PVD process is used, some polishing of the receiving surface prior to deposition may be needed. The material of the second layer 22 preferably has a density greater than that of the first layer 20, and it may have a density of at least 85% of its theoretical density. This high overall density is a result of the highly dense material 24 between the gaps 26. Such high density makes the second layer 22 less susceptible to sintering. Because of its columnar-grained structure and the presence of the plurality of gaps 26, the second layer 22 provides strain tolerance and resistance against thermal shock damage for the thermal barrier coating 12. In order to minimize the possibility of sintering of adjacent columns 24 a sinter-inhibiting material 30 may be deposited on the second layer 22 between adjacent columns 24 of the columnar-grained structure, as described in U.S. Pat. No. 5,562,998 issued to Subramanian and Sabol and assigned to the assignee of the present invention. The sinter-inhibiting material 30 may be aluminum oxide or yttrium aluminum oxide, for example.

The first layer 20 may be deposited to have a degree of porosity sufficiently high so that the pores 28 in the first layer 20 function to arrest the propagation of a crack originating at the generally vertical gaps 26. Prior art columnar-grained insulating materials are known to exhibit a failure mode wherein cracks propagate from the columnar gaps, thereby leading to failure of the coating. The present invention provides a crack-arresting structure to reduce the risk of such failures.

The thermal barrier coating 12 may be applied by an APS process using equipment and processes known in the art. In one example, a Sulzer Metco Model 9MB plasma spray gun was used at a voltage of 75 VAC and a power level of 650 amps to apply both an 8% YSZ material as both the first layer 20 and the second layer 22. The porous first layer 20 was applied using a powder feed rate of 37 gram/minute at a 5 inch spray distance with a 305 mm/second traverse rate. The substrate temperature was about 300 degrees C. prior to spraying. The one pass of the gun provided a first layer coating thickness of about 3 mils. The second layer was later deposited with the surface temperature again at about 300 degrees C. A 20 gram/minute powder feed rate was used with a 2.5 inch spray distance and a 75 mm/second traverse speed. This one pass provided a second layer thickness of about 12 mils, resulting in a total TBC thickness of about 15 mils.

A broad range of deposition variable may be used to tailor a TBC for a particular application. The first porous layer 20 may be applied in 1–4 passes of 1–5 mils per pass using a powder feed rate of 30–75 gram/minute, a spray distance of 4–8 inches and a traverse speed of 100–500 mm/second. The second columnar grained layer 22 may be applied in 1–4 passes to achieve a coating thickness of 3–25 mil/pass using a powder feed rate of 10–50 gram/minute, a spray distance of 1.5–5 inches and a traverse speed of 25–125 mm/second. The deposition surface temperature should be maintained in the range of 100–400 degrees C. prior to deposition for each of these layers.

The thermal barrier coating 12 of the present invention overcomes many of the disadvantages of prior art thermal barrier coatings. Because both the first layer 20 and second layer 22 may be deposited by an air plasma spray process, the coating 12 is expected to be relatively economical to produce when compared to prior art EB-PVD coatings. The porous first layer 20 provides good adhesion to the underlying substrate 16 or bond coat 18 and it provides a barrier against the migration of harmful environmental constituents to the substrate surface 14. It also provides a lower thermal conductivity than would a coating with a columnar microstructure extending through the complete thickness of the coating. The pores 28 of the first layer 20 act as crack arrestors for mitigating cracks initiated in the second layer 22. The presence of the porous first layer 20 also protects the underlying bond coat 18 from oxidation during the high temperature deposition of the second layer 22. The relatively dense second layer 22 having a plurality of gaps 26 formed therein provides a high degree of strain tolerance for the coating 12. Other specific embodiments may be envisioned having multiple porous and dense layers to address the environmental conditions of any particular application.

While the preferred embodiments of the present invention have been shown and described herein, it will be obvious that such embodiments are provided by way of example only. Numbers variations, changes and substitutions will occur to those of skill in the art without departing from the invention herein. Accordingly, it is intended that the invention be limited only by the spirit and scope of the appended claims.

I claim as my invention:

1. A thermal barrier coating comprising:

a first layer of ceramic insulating material having a microstructure characterized by a plurality of individual splats lacking a continuous columnar grain structure throughout the first layer; and a second layer of ceramic insulating material disposed on the first layer, the second layer having a columnar-grained structure wherein columns of material are separated by a respective plurality of gaps extending in a direction transverse to a plane of interface between the first and second layers.

2. The thermal barrier coating of claim 1, wherein the first layer has a density of no more than 85% of its theoretical density.

3. The thermal barrier coating of claim 1, wherein the first layer has a density in the range of 70–85% of its theoretical density.

4. The thermal barrier coating of claim 1, wherein the second layer has a density of at least 85% of its theoretical density.

5. The thermal barrier coating of claim 1, further comprising a sinter-inhibiting material disposed on the second layer between adjacent columns of the columnar-grained structure.

6. The thermal barrier coating of claim 1, further comprising a layer of bond coat material deposited against the first layer opposed the second layer and providing a bond between the first layer and a substrate material.

7. The thermal barrier coating of claim 1, wherein gaps between adjacent columns of the columnar-grained structure extend in a direction having an angle of at least 75 degrees from a plane of interface between the first and second layers.

8. The thermal barrier coating of claim 1, further comprising:

the first layer of ceramic material having a first density;

the second layer of ceramic material having a density greater than the density of the first layer; and a plurality of gaps formed in the second layer, the gaps extending in a direction transverse to a plane of interface between the first and second layers but not extending into the first layer.

9. The thermal barrier coating of claim 8, further comprising:

the first density being no more than 85% of the theoretical density of the first layer of ceramic material; and the second layer having a density of at least 85% of its theoretical density.

10. The thermal barrier coating of claim 8, wherein the gaps comprise spaces between adjacent columns of the columnar-grained structure of the second layer of ceramic insulating material.

11. An article having a thermal barrier coating, comprising:

a substrate having a surface;

a thermal barrier coating deposited over the surface of the substrate, the thermal barrier coating further comprising:

a first layer of ceramic insulating material disposed over the substrate surface, the first layer characterized by a plurality of individual splats of material and lacking a continuous columnar grain structure throughout the first layer; and a second layer of ceramic insulating material disposed on the first layer, the second layer having a columnar grained structure wherein columns of material are separated by a respective plurality of gaps extending in a direction transverse to a plane of interface between the first and second layers.

12. The article of claim 11, further comprising a bond coat material deposited between the substrate surface and the first layer of ceramic insulating material.

13. A method of insulating a substrate, the method comprising:

depositing a first layer of a ceramic insulating material over the substrate using an air plasma spray process to obtain a microstructure in the first layer characterized by a plurality of individual splats lacking a continuous columnar grain structure throughout the first layer; and depositing a second layer of a ceramic insulating material over the first layer using a process that results in a columnar-grained structure in the second layer wherein columns of material are separated by a respective plurality of gaps extending in a direction transverse to a plane of interface between the first and second layers.

14. The method of claim 13, further comprising depositing the first layer to have a density of no more than 85% of its theoretical density.

15. The method of claim 13, further comprising depositing the first layer to have a density in the range of 70–85% of its theoretical density.

16. The method of claim 13, further comprising depositing the second layer to have a density of at least 85% of its theoretical density.

17. The method of claim 13, further comprising depositing a sinter-Inhibiting material on the second layer between adjacent columns of the columnar-grained structure.

18. The method of claim 13, further comprising depositing a layer of bond coat material onto a substrate material prior to depositing the first layer and depositing the first layer onto the layer of bond coat material.

19. The method of claim 13, further comprising using an air plasma spray process to deposit the second layer.

20. The method of claim 13, further comprising depositing the first layer to have pores so that the pores in the first layer arrest the propagation of cracks originating in the second layer.

* * * * *